United States Patent [19]

Noble

[11] Patent Number: 4,846,530

[45] Date of Patent: Jul. 11, 1989

[54] THREE ELEMENT CHAIR

[76] Inventor: Neal Noble, R.F.D. #2, Box 128, West Brattleboro, Vt. 05301

[21] Appl. No.: 236,617

[22] Filed: Aug. 25, 1988

[51] Int. Cl.[4] ..... A47C 7/00

[52] U.S. Cl. ..... 297/443; 297/440; 297/442

[58] Field of Search ..... 297/442, 443, 440

[56] References Cited

U.S. PATENT DOCUMENTS

| | | | |
|---|---|---|---|
| D. 165,776 | 1/1952 | Nelson . | |
| D. 230,924 | 3/1974 | Rashbam . | |
| 2,881,824 | 4/1959 | Hermann | 297/443 X |
| 2,914,117 | 9/1959 | Underwood . | |
| 3,427,074 | 2/1969 | Whyte | 297/443 |
| 3,460,866 | 8/1969 | Kessel | 297/442 |
| 3,485,527 | 12/1969 | Borghout | 297/442 |
| 3,752,532 | 8/1973 | Yarus . | |
| 3,847,435 | 11/1974 | Skinner . | |
| 4,129,332 | 12/1978 | Hoeholt . | |
| 4,188,067 | 2/1980 | Elmer | 297/442 |
| 4,225,180 | 9/1980 | Gillis . | |
| 4,234,227 | 11/1980 | Faust . | |
| 4,593,950 | 6/1986 | Infanti . | |

FOREIGN PATENT DOCUMENTS

| | | | |
|---|---|---|---|
| 2270769 | 12/1975 | France | 297/443 |

*Primary Examiner*—Francis K. Zugel

*Attorney, Agent, or Firm*—Jones, Tullar & Cooper

[57] ABSTRACT

A three element chair is formed of cooperating back, seat and seat support components. The three elements are quickly assemblable to form a sturdy, non-collapsing seat assembly. Mortice and tenon and tongue and groove joints provide the joint structures and no auxiliary fasteners are utilized.

5 Claims, 2 Drawing Sheets

THREE ELEMENT CHAIR

FIELD OF THE INVENTION

The present invention is directed generally to a chair. More particularly, the present invention is directed to a three element chair. Most specifically, the present invention is directed to a three interfitting element chair. These three interfitting elements, which are a chair back and front leg, a chair seat, and a chair seat support and rear leg cooperate with each other to quickly and easily form a comfortable, sturdy chair whose stability is increased as a person sits on it. The three interfitting elements which form the chair require no additional fasteners and can be put together and taken apart for ease in transportation and for compact storage in an expeditious manner.

DESCRIPTION OF THE PRIOR ART

Chairs and seating assemblies which are generally collapsible, foldable, or which can be taken apart for storage, are generally well known in the prior art. Any number of metal and wooden folding chairs are available and are provided with a wide variety of hinge structures, link arms, pivot points and similar mechanisms for effecting folding or collapse of the chair for storage while allowing erection of the chair for use. As is well known to anyone who has struggled with these chairs, they are often heavy, cumbersome, and not altogether satisfactory in use. Every hinge and linkage assembly devised to make the chair easier to use tends to result in a more expensive, more complex and frequently less secure assembly. The time and energy required to erect, take down, transport and store these generally well known prior art folding chairs almost seems to be more than should be required to provide a person a sturdy, comfortable place to sit.

The use of cooperating components to form a chair is also known generally in the prior art. For example, the patents to Yarus, U.S. Pat. No. 3,752,532; to Skinner, U.S. Pat. No. 3,847,435; and to Holthost, U.S. Pat. No. 4,129,332 are exemplary of two component chairs which are intended to be assembled for use and to be taken apart for storage. It is often the situation with cooperating component chairs of this type that while the concept is good, the actual piece of furniture is not. Too often, the prior art devices of this general type have been uncomfortable, unstable, and generally unsuitable for actual use. In addition, the use of various curved and angled components, which have been used in an effort to provide stability, have resulted in pieces that cannot be easily transported or stored in a space efficient manner.

It will thus be apparent that a need exists for a multiple component chair which is simple yet efficient, which is inexpensive yet sturdy, and which overcomes the various deficiencies of the prior art devices. The three element chair of the present invention provides such an assembly and is a significant advance in the art.

SUMMARY OF THE INVENTION

It is an object of the present invention to provide a three element chair.

Another object of the present invention is to provide a three interfitting element chair.

A further object of the present invention is to provide a three linear interfitting element chair.

Yet another object of the present invention is to provide a three element chair which requires no additional fasteners.

Still a further object of the present invention is to provide a three element chair whose stability is increased during useage.

Even yet another object of the present invention is to provide a three element chair which is rugged and durable.

As will be discussed in detail in the description of the preferred embodiment which is set forth subsequently, the three element chair in accordance with the present invention utilizes three interfitting elements to form a rugged, durable, chair. All three of the interfitting elements are linear and are quickly and easily assembled and taken apart. These three elements include a chair back and integral front leg, a back leg and seat support, and a seat. Upon assemblage, these three cooperating elements form a chair which is stable, and useable, while maintaining its simplicity and ease of transportation, storage, and disassembly.

In clear contrast with the generally well known prior art metal, wood and plastic folding chairs, the three element chair of the present invention uses no hinges, pivot links or other complex mechanical structure. Thus it cannot break, jamb or otherwise malfunction. Clearly then, this chair is less complicated and less expensive than these prior devices.

In comparison with the somewhat more similar multiple component chairs of the prior art, the three element chair of the present invention is more stable, less bulky, and more easily put together and taken apart for transportation and for storage in less space. Each of the three elements of the present chair is linear and planar so that when the chair is taken apart, it will take very little storage space. This is in marked contrast to various ones of the prior art devices which have curved or arcuate components that require a substantial amount of space when the chair is taken apart.

The three elements of the present chair utilize a triangulation principle that increases stability when the chair is used. The weight of a person sitting on the chair seat will tend to broaden the base of the chair as well as to direct the three interfitting elements into more secure cooperation. Thus when a person is seated on the chair, it is even more stable and secure than when not in use. This structural cooperation and configuration is also an advantage over the prior art devices.

The three element chair in accordance with the present invention is a very efficient seating device which is superior to prior devices. It is easily put together and taken apart, has only three interfitting linear elements, and can be made from a variety of materials. It is simple yet effective and provides a very satisfactory seating device. Additionally, it is easy to transport and stores in a minimum amount of space.

BRIEF DESCRIPTION OF THE DRAWINGS

While the novel features of the three element chair of the present invention are set forth with particularity in the appended claims, a full and complete understanding of the invention may be had by referring to the detailed description of the preferred embodiment which is set forth subsequently, and as is illustrated in the accompanying drawings, in which:

DESCRIPTION OF THE PREFERRED EMBODIMENT

Figure 1:
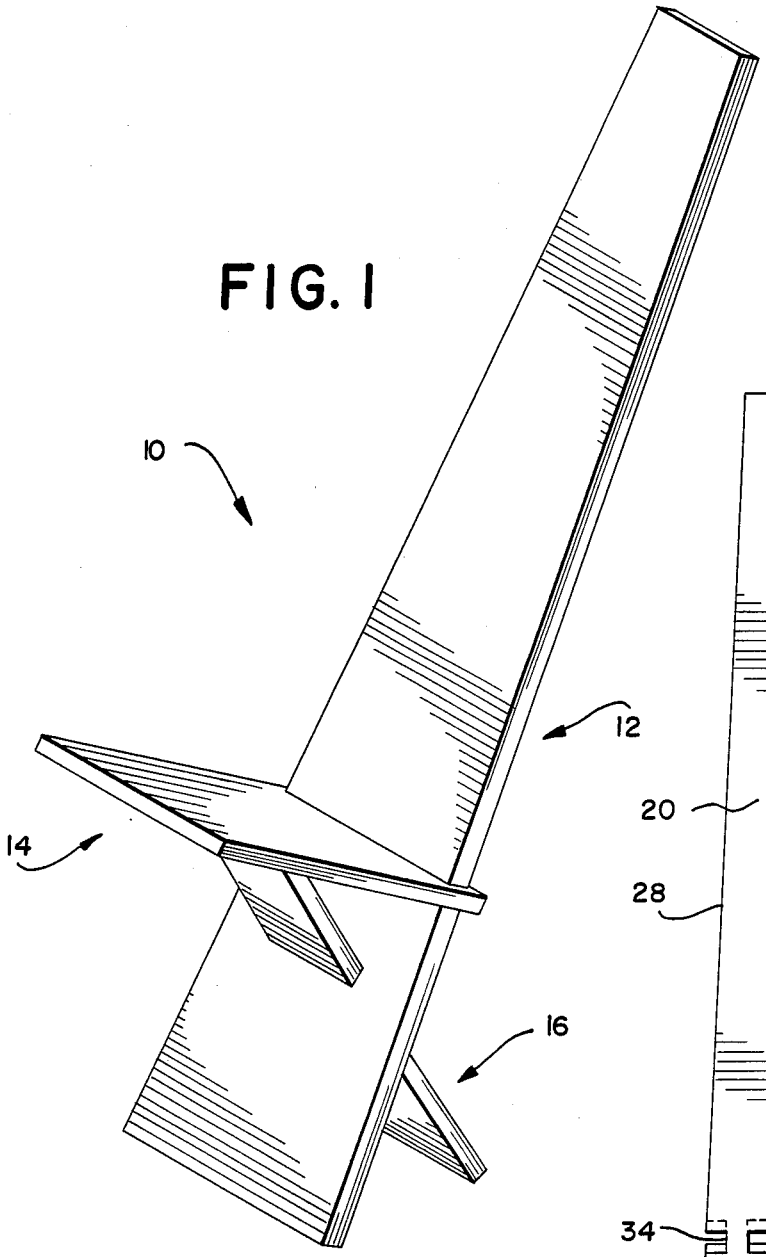
FIG. 1 is a perspective view of an assembled three element chair in accordance with the present invention.

Referring initially to FIG. 1 there may be seen, generally at 10, a preferred embodiment of a three element chair in accordance with the present invention. Chair 10 is formed of three cooperating interfitting elements or components which are a chair back and front leg, generally at 12; a chair seat, generally at 14; and a chair seat support and rear leg, generally at 16. Each of these elements or components will be discussed in detail shortly, but as is best seen in FIG. 1, these three elements interfit and cooperate to form chair 10. The chair has a generally triangular shaped base and, when a person is seated on chair seat 14, his weight will tend to increase the width of the triangular base thereby even further increasing the stability of chair 10.

Figure 2:
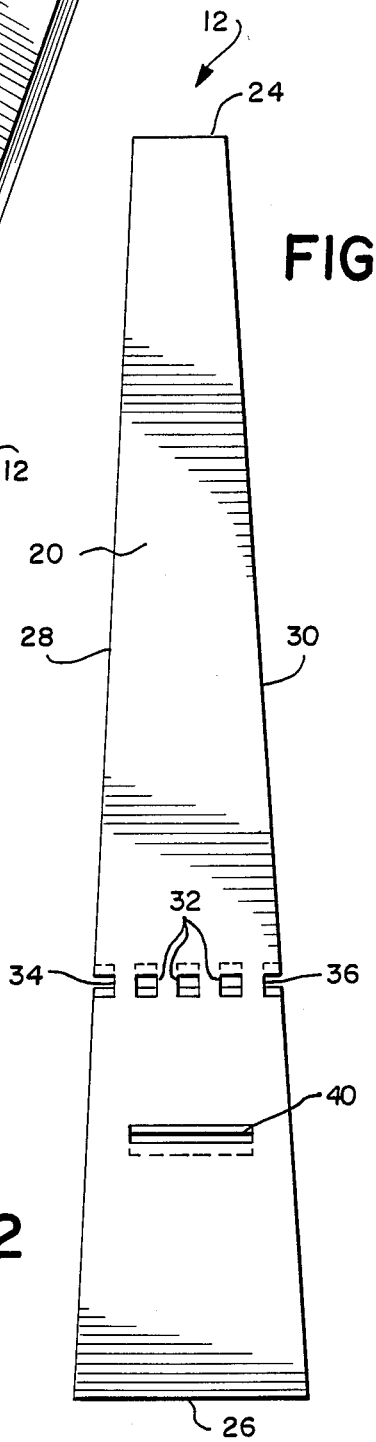
FIG. 2 is a front elevation view of the chair back and front leg of the three element chair.
Figure 3:
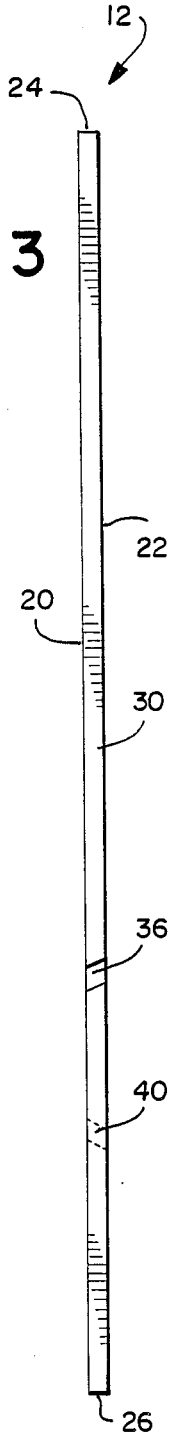
FIG. 3 is a side elevation view of the chair back and front leg of FIG. 2.

Turning now to FIGS. 2 and 3, chair back and front leg, generally at 12 is shown as being a generally elongated rectangular planar member having a front surface 20, a rear surface 22, an upper edge 24, a lower edge 26, and left and right sides 28 and 30, respectively. A plurality of equally spaced mortice apertures 32 are placed in a generally horizontal line, generally at seating height, across the surface of chair back 12. These mortice apertures are bounded by left and right partial mortice openings 34 and 36 formed in the left and right sides 28 and 30, respectively of chair back and front leg 12. As may be seen in FIG. 3, these apertures and openings 32, 34 and 36 pass completely through from the front surface 20 to the rear surface 22. As may also be seen in FIG. 3, these apertures and openings are inclined generally downwardly and toward the forward surface 20. In the preferred embodiment, each opening 32 is generally about $1\frac{1}{8}$ inch square and the angle of downward slope is generally about 17°.

A chair seat support aperture 40 is also formed in chair back and front leg 12. This chair seat support aperture 40 is positioned generally about half way between the line of mortice apertures and openings 32, 34, and 36, and the lower edge 26 of chair back 12. As may be seen most clearly in FIG. 2, chair seat support aperture 40 is, in the preferred embodiment, generally rectangular having a width of generally about $5\frac{1}{8}$ inches and a height of generally about $1\frac{3}{8}$ inches. It is spaced equidistantly from both of the sides 28 and 30 of chair back 12. As may be seen most clearly in FIG. 3, aperture 40 has an inclined slope from rear surface 22 to front surface 20 of chair back 12. This inclined slope, which is opposite to the declined slope of mortice apertures and openings 32, 34 and 36 is, in the preferred embodiment, generally about 30°.

While chair back and front leg 12 is depicted as being generally rectangular, it will be understood that other shapes could be utilized. The upper portion of chair back 12; i.e., that portion above the mortice aperture and openings 32 and 34 and 36 could be formed in any number of shapes, as desired. Also, the lower portion of chair back 12; i.e., that portion below chair seat support aperture 40 could be formed having other than the straight lower edge depicted at 26.

Figure 4:
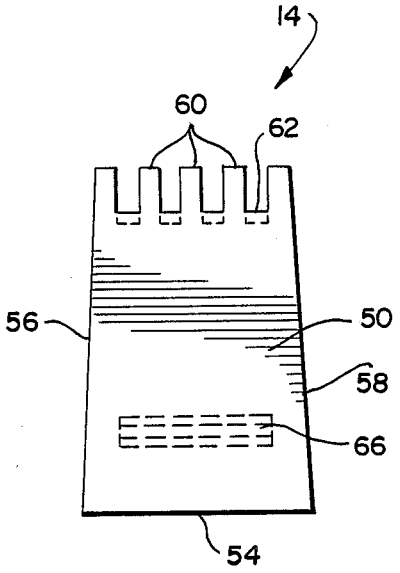
FIG. 4 is a front elevation view of the chair seat of the three element chair of the present invention.
Figure 5:
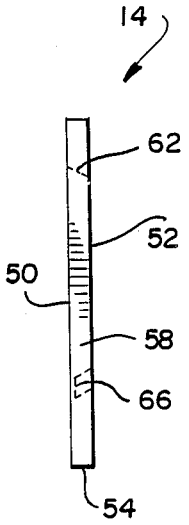
FIG. 5 is a side elevation view of the chair seat of FIG. 4.

The chair seat element 14 of the three element chair 10 may be seen most clearly in FIGS. 4 and 5. As is there depicted, chair seat 14 is generally rectangular and has an upper surface 50, a lower surface 52, a front edge 54, left and right side edges 56 and 58 and a plurality of spaced tenons 60 which form a rear edge of chair seat 14. These rear tenons 60 are shaped and dimensioned to fit into the cooperatively shaped and positioned mortice apertures and openings 32, 34 and 36 formed in chair back 12, as discussed above. In the preferred embodiment, each of the three central tenons is generally about 1 inch wide while the two partial side tenons are each generally about $\frac{3}{4}$ inch wide. The length of each of the tenons is generally about 2 inches and since the thickness of chair back 12 is generally about 1 inch, these tenons 60 extend rearwardly beyond the rear surface 22 of chair back 12 in their assembled position, as seen in FIG. 1. This insures that the tenons 60 cannot slip or be forced out of their corresponding apertures or openings 32, 34 of 36.

The inner wall 62 between adjacent tenons 60 slopes downwardly toward lower surface 52 of chair seat, as seen most clearly in FIG. 5. The angle of the slope is, in the preferred embodiment, generally about 20° and complements the slope of the mortice apertures and openings 32, 34 and 36 in chair back 12. This cooperation in slopes provides a somewhat upwardly angled chair seat orientation, as shown in FIG. 1, when the chair seat tenons 60 are inserted into the chair back mortice aperture and openings 32, 34, and 36.

A chair seat support groove 66 is formed in the lower surface 52 of chair seat 14. As may be seen in FIG. 4, chair seat support groove 66 is a generally elongated rectangle which extends generally parallel to front edge 54 of chair seat 14, and which is spaced equally from chair seat left and right side edges 56 and 58. As is shown in FIG. 5, chair seat support groove 66 does not pass completely through chair seat 14. In the preferred embodiment, it has a depth of generally about $\frac{3}{4}$ inch compared to the 1 inch thickness of chair seat 14. Chair seat support groove 66 is inclined oppositely to inner wall 62. In the preferred embodiment, the walls of groove 66 slope downwardly toward the upper surface of chair seat 14 at an angle of generally about 45°.

As was the situation with chair back 12, the depiction of chair seat 14 as rectangular is not to be construed as limiting. It will be understood that various other configurations of chair seat 14 would be appropriate. Thus front edge 54 and left and right sides 56 and 58 could be curved or the like, if desired.

Figure 6:
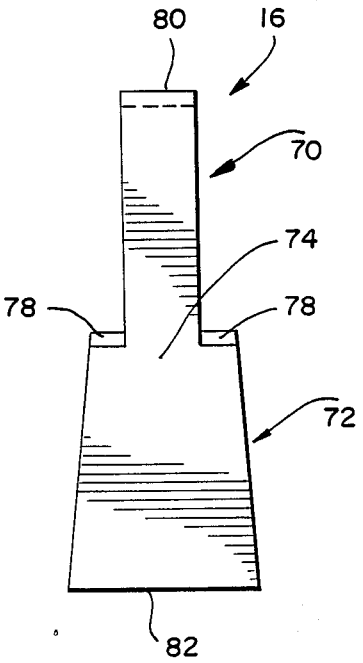
FIG. 6 is a front elevation view of the chair seat support and rear leg of the three element chair.
Figure 7:
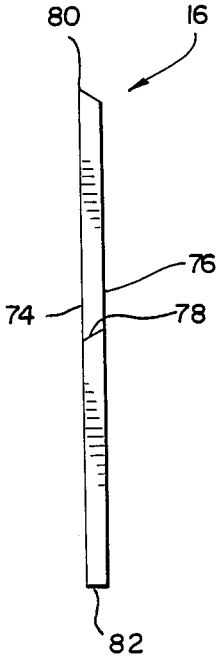
FIG. 7 is a side elevation view of the chair seat support and rear leg of FIG. 6.

Chair seat support and rear leg 16, is shown most clearly in FIGS. 6 and 7. As may be seen there, this element has an upper, chair seat support portion 70 and a lower rear leg portion 72. Both portions share a front surface 74 and a rear surface 76. Chair seat support portion 70 is of reduced width and joins rear leg portion 72 at spaced seat back abutment surfaces 78. The reduced width chair seat support portion 70 terminates in an upper tongue 80 which is sized and angled to be receivable in the chair seat support groove 66 provided in the lower surface 52 of chair seat 14. The width of chair seat support portion 70 of chair seat support and rear leg 16 is selected to be able to pass through chair seat support aperture 40 in chair back 12. In the preferred embodiment, the width of the chair seat support portion 70 is generally about $4\frac{7}{8}$ inches while the angle of declination of tongue 80 is generally about 65°. The widths of the two seat back abutment surfaces 78 are each generally about $1\frac{1}{8}$ inch, and it will be understood that these two surfaces contact the rear surface 22 of chair back 12 when the chair seat support portion 70 passes through the chair seat support aperture 40. A lower edge 82 of rear leg portion 72 of chair seat support and rear leg 16 is generally parallel to seat abutment surface 78 and seat groove engaging upper tongue 80. The overall length of chair seat support and rear leg 16 is, in the preferred embodiment generally about $22\frac{1}{2}$ inches with the distance from the lower edge 82 to the forwardly downwardly angled seat abutment surface 78 being generally about 11 inches. These abutment surfaces have a forward angle of declination of about 25° in the preferred embodiment. As with the other two elements, the actual shape of the chair seat and rear leg 16 may be varied. Thus the sides of the rear leg portion 72 may be curved instead of straight as may be the sides of the chair seat support portion 70, so long as this portion will fit through the chair seat support aperture 40 in chair back 12. This element, as do the other two elements in the preferred embodiment, has a thickness of 1 inch.

To assemble the three elements of chair 10 of the present invention, the chair back 12 may be placed in a generally vertical orientation with its lower edge 26 on the floor. The chair seat support portion 70 of the chair seat support and rear leg 16 may be inserted from the rear surface 22 of chair back 12 through chair seat support aperture 40 until the seat back abutment surfaces 78 contact the rear surface 22 of chair back 12 adjacent the chair seat support aperture 40. Once this has been done, the resulting assembly is self supporting since there is formed a generally triangular support base. The chair seat 14 is now put in place by insertion of its spaced tenons 60 into the cooperatively shaped mortice apertures and openings 32, 34 and 36 in chair back and front leg 12. The assembly is completed by inserting the tongue 80 of the chair seat support 70 into the chair seat support groove 66 on the lower surface 52 of chair seat 14. The resulting three element chair 10 is now useable and provides a stable support for a person. The person's weight on chair seat 14 serves to increase the stability of the assembly. Downward force on chair seat 14 further seats tongue 80 in groove 66 while forcing tenons 60 into mortices 32, 34 and 36. This same downward force urges the legs apart and brings seat back abutment surfaces 78 on chair seat support and rear leg 16 into more intimate contact with the rear of the chair front leg 12. Thus the weight of the person using the chair increases its stability. Thus it can be seen that it is virtually impossible for the three element chain to fail in use. However, when the chair 10 is no longer needed, it can be quickly and easily taken apart by lifting up on the front edge 54 of chair seat 14 to unseat tongue 80 from groove 66. The chair seat 14 can be separated from the chair back 12 and the chair seat support and rear leg 16 slid out of chair seat support aperture 40. The result is three planar pieces which can be secured together by a suitable strap or the like, if desired, and which can then be easily transported and stored in a minimum of space.

While a preferred embodiment of a three element chair in accordance with the present invention has been set forth fully and completely hereinabove, it will be apparent to one of skill in the art that a number of changes in, for example, the materials used to construct the chair, the overall appearance of the chair and the like can be made without departing from the true spirit and scope of the invention which is to be limited only by the following claims.

What is claimed is

1. A three interfitting element chair assembly comprising:

a chair back and front leg having a front surface and a rear surface, a plurality of mortice openings passing through said chair back and front leg, said mortice openings being inclined generally downwardly from said rear surface to said front surface of said chair back and front leg, and further having a chair seat support aperture positioned beneath said mortice openings and passing through said chair back and front leg, said chair seat support aperture being inclined generally upwardly from said rear surface to said front surface of said chair back and front leg generally oppositely in inclination to said mortice openings;

a chair seat having a plurality of rearwardly projecting tenons which are sized to be removably receivable in said mortice openings whereby said chair seat is attachable to said chair back and front leg, and having a chair seat support groove formed in a lower surface of said chair seat; and a chair seat support and rear leg having an upper chair seat support portion and a lower rear leg portion, said upper chair seat support portion being of reduced width and joining said lower rear leg portion at spaced seat back abutment surfaces, said upper chair seat support portion being insertable through said chair seat support aperture and having an upper tongue portion receivable in said chair seat support groove in said lower surface of said chair seat, said spaced seat back abutment surfaces having a forward angle of declination and abutting said rear surface of said chair back and front leg on both sides of said chair seat support aperture whereby a downward force applied to an upper surface of said chair seat urges said spaced seat back abutment surfaces into more intimate contact with said rear surface of said chair back and front leg while concurrently forcing said tenons into said mortice openings.

2. The three element chair of claim 1 wherein said tenons are generally square in cross section and are each spaced from each other by generally a width of a tenon.

3. The three interfitting element chair of claim 1 wherein inner wall segments between each of said tenons slope downwardly towards a lower surface of said chair seat.

4. The three interfitting element chair of claim 3 wherein said chair seat support groove is an elongated rectangle which extends generally parallel to a front edge of said chair seat and is inclined oppositely to said inner wall segments.

5. The three interfitting element chair of claim 1 wherein said upper tongue portion of said upper chair seat support portion has an angle of declination generally opposite to said angle of declination of said spaced seat back abutment surfaces.

* * * * *